US010919125B2

(12) United States Patent
Takata et al.

(10) Patent No.: US 10,919,125 B2
(45) Date of Patent: Feb. 16, 2021

(54) GRINDSTONE

(71) Applicant: NANO TEM CO., LTD., Nagaoka (JP)

(72) Inventors: Atsushi Takata, Nagaoka (JP); Masakazu Takatsu, Mitsuke (JP); Kyosuke Ohashi, Nagaoka (JP); Kozo Ishizaki, Nagaoka (JP); Norio Onodera, Nagaoka (JP)

(73) Assignee: NANO TEM CO., LTD., Nagaoka (JP)

( * ) Notice: Subject to any disclaimer, the term of this patent is extended or adjusted under 35 U.S.C. 154(b) by 0 days.

(21) Appl. No.: 16/342,886

(22) PCT Filed: Oct. 19, 2016

(86) PCT No.: PCT/JP2016/080911
§ 371 (c)(1),
(2) Date: Apr. 17, 2019

(87) PCT Pub. No.: WO2018/073905
PCT Pub. Date: Apr. 26, 2018

(65) Prior Publication Data
US 2019/0247980 A1 Aug. 15, 2019

(51) Int. Cl.
*B24D 3/18* (2006.01)
*B24D 3/10* (2006.01)
(Continued)

(52) U.S. Cl.
CPC ..... *B24D 7/18* (2013.01); *B24D 3/00* (2013.01); *B24D 3/10* (2013.01); *B24D 3/18* (2013.01);
(Continued)

(58) Field of Classification Search
CPC ..... B24D 7/18; B24D 7/10; B24D 2203/00; B24D 3/00; B24D 3/10; B24D 3/18; B24D 3/26; B24D 3/32
See application file for complete search history.

(56) References Cited

U.S. PATENT DOCUMENTS 4,350,497 A * 9/1982 Ogman ..... B24D 5/04 428/117
6,783,450 B1 * 8/2004 Meyer ..... B24B 9/14 451/548
(Continued)

FOREIGN PATENT DOCUMENTS

JP H04-046773 A 2/1992
JP H04-129675 A 4/1992
JP 2004-255518 A 9/2001
(Continued)

OTHER PUBLICATIONS

Dec. 27, 2016 International Search Report issued in International Patent Application No. PCT/JP2016/080911.
(Continued)

*Primary Examiner* — Pegah Parvini
(74) *Attorney, Agent, or Firm* — Oliff PLC

(57) ABSTRACT

A grindstone that enables grinding, polishing, super-finish polishing by using the same grindstone, without clogging even if the grindstone is being used continuously, in which a grinding/polishing section for processing a workpiece has a honeycomb structure formed by arranging polygonal prisms with no clearance therebetween. The grindstone includes the grindstone columns consisting of abrasive grains and binder and having an axis in depth direction of grinding/polishing surface, which are disposed on intersections or wall portions of the honeycomb structure. Porous elastomer is disposed inside the honeycomb structure, thus making it possible to perform a super-finish polishing.

8 Claims, 10 Drawing Sheets

(51) Int. Cl.

| | |
|---|---|
| ***B24D 3/32*** | (2006.01) |
| ***B24D 7/10*** | (2006.01) |
| ***B24D 3/26*** | (2006.01) |
| ***B24D 3/00*** | (2006.01) |
| ***B24D 7/18*** | (2006.01) |

(52) U.S. Cl.
CPC ..... *B24D 3/26* (2013.01); *B24D 3/32* (2013.01); *B24D 7/10* (2013.01); *B24D 2203/00* (2013.01)

(56) References Cited

U.S. PATENT DOCUMENTS

| | | | |
|---|---|---|---|
| 2007/0004180 | A1 | 1/2007 | Abe |
| 2015/0258656 | A1 | 9/2015 | Takada et al. |

FOREIGN PATENT DOCUMENTS

| | | | |
|---|---|---|---|
| JP | 2003-300165 | A | 10/2003 |
| JP | 2005-297139 | A | 10/2005 |
| JP | 2007-012810 | A | 1/2007 |
| JP | 2014-083611 | A | 5/2014 |

OTHER PUBLICATIONS

Office Action dated Nov. 2019 in Japanese Patent Application No. 2015-231332.

* cited by examiner

[Fig.1]
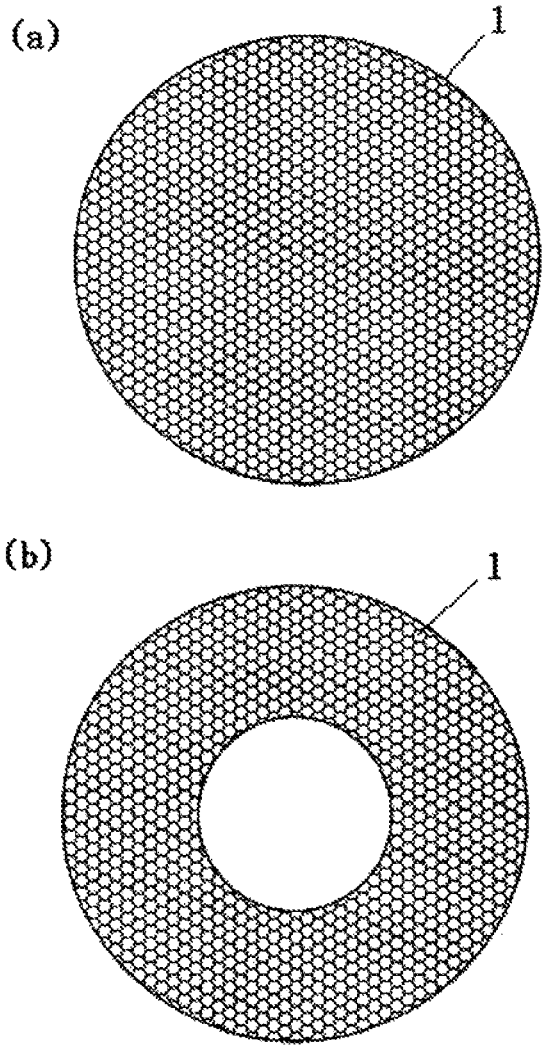

[Fig.2]
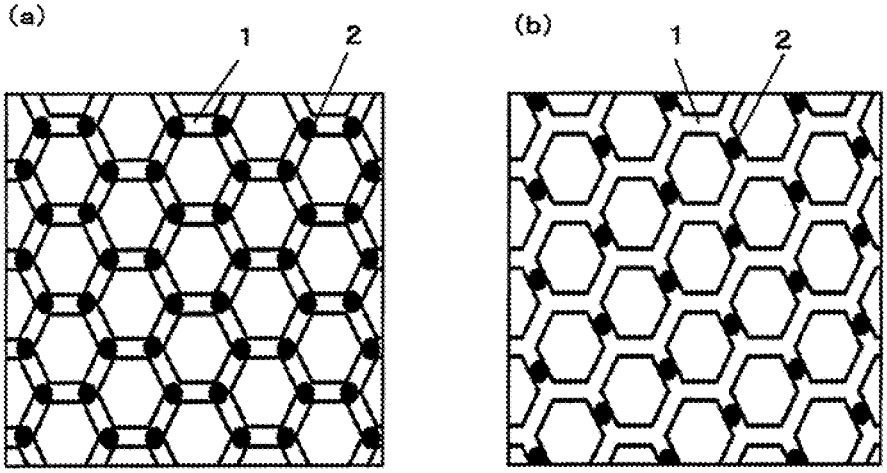

[Fig.3]
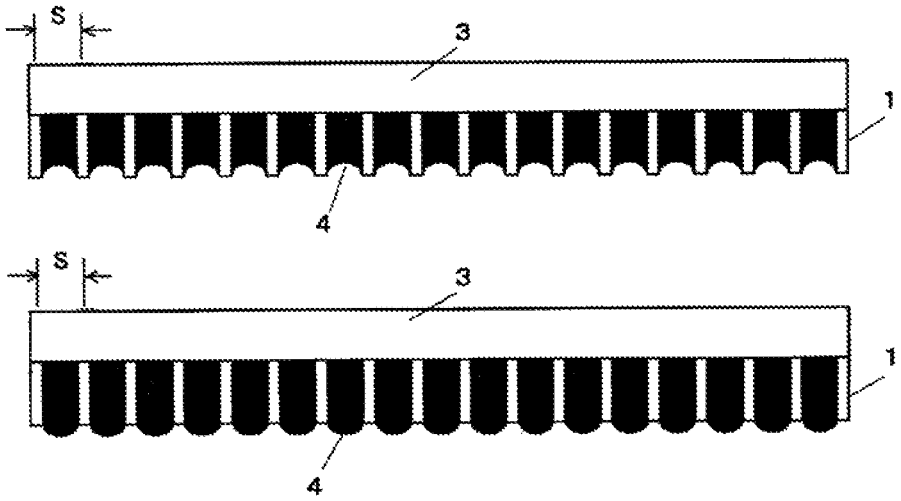

[Fig.4]
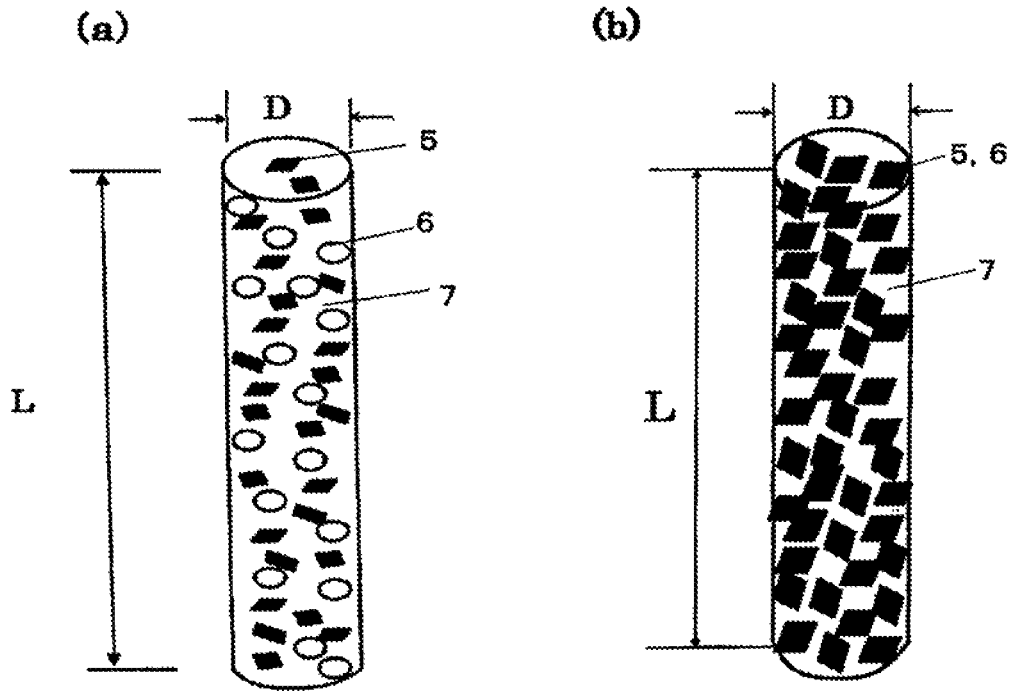

[Fig.5]
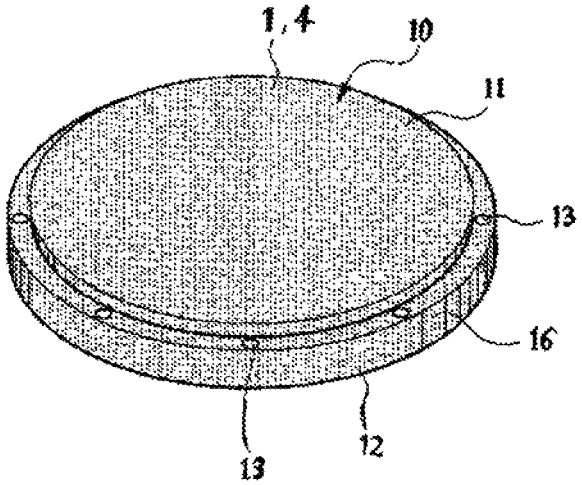

[Fig.6]
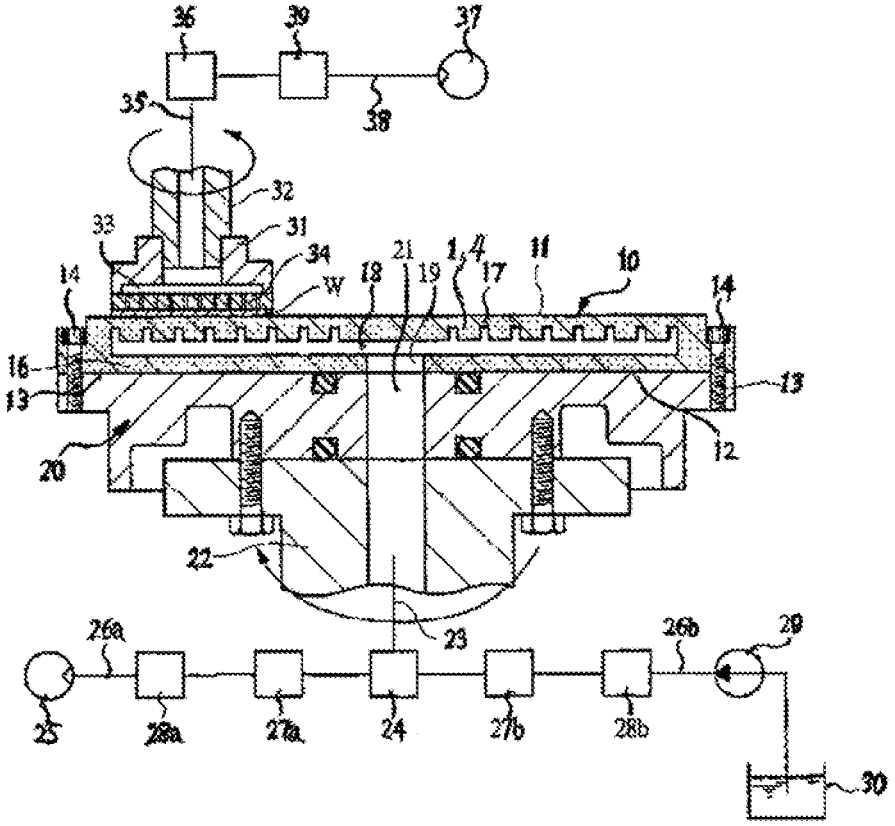

[Fig.7]
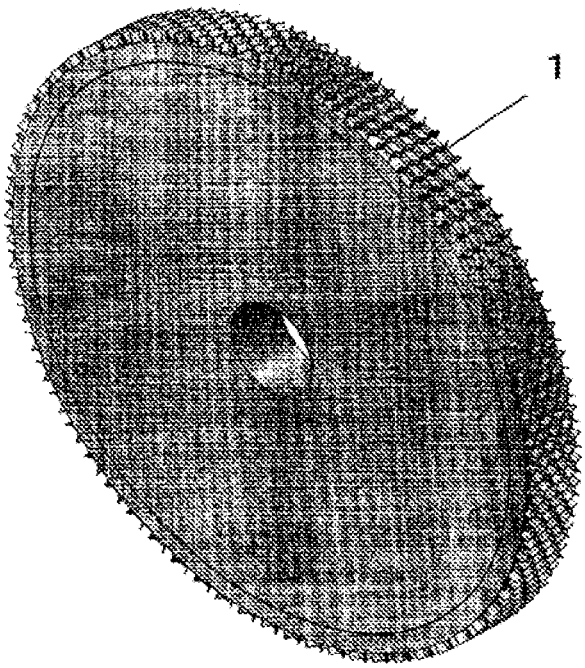

[Fig. 8]
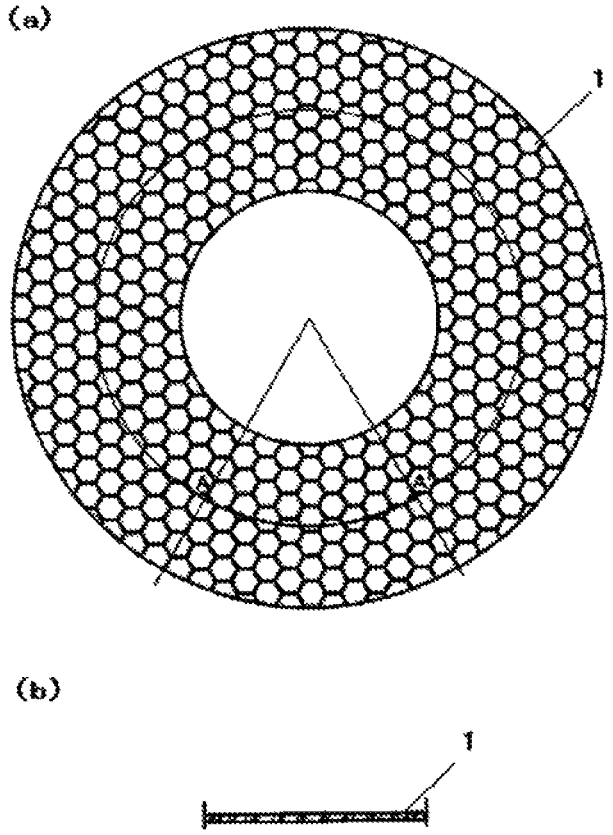

[Fig.9]
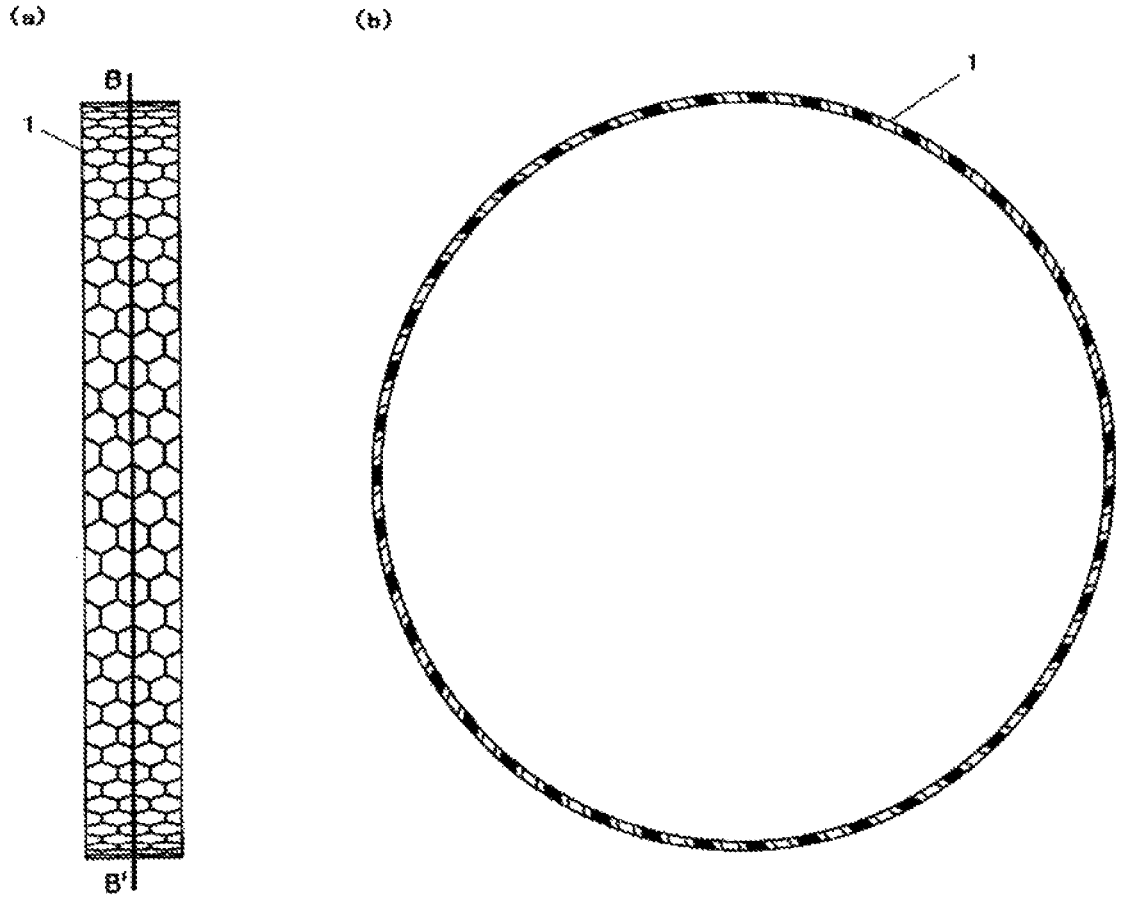

[Fig.10]
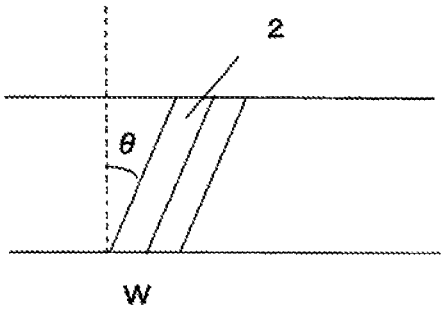

GRINDSTONE

TECHNICAL FIELD

The present invention relates to a grindstone for grinding and polishing a workpiece. More specifically, this invention relates to a grindstone for grinding and polishing a workpiece such as ceramics, silicon wafer, semiconductor substrate, LED substrate, heat dissipating substrate, SiC, alumina, sapphire, metal, alloy and the like.

BACKGROUND ART

A grindstone is a tool formed by using a binder to combine hard particles which are abrasive grains, followed by a forming or shaping process. A process using a grindstone includes grinding and polishing. Customarily, grinding is called a rough machining, while polishing is called finish machining. In these processes, with a grindstone being pressed against a workpiece, the grindstone and the workpiece are caused to relatively move with respect to each other, thereby using abrasive grains to abrade the surface of the workpiece by removing a large amount of ground chips. However, in this specification, grinding/polishing refers to both grinding and polishing. For polishing process, there is a method in which abrasive grains are not fixed but caused to float in a fluid, and to allow soft buffs to move into the fluid so that the floating abrasive grains are brought into contact with the workpiece to reach a desired polishing. This method is called a super-finish polishing (ultra-polishing or super-polishing).

In grinding/polishing using a grindstone, there are a cylindrical grinding/polishing process for processing the outer peripheral surface of a cylindrical shape of a workpiece, an inner grinding/polishing process for processing an inner peripheral cylindrical surface of a workpiece, and a flat surface grinding/polishing process for processing a flat surface of an object. As a grindstone for processing the outer peripheral surface and the inner peripheral surface, what is used is a grindstone having a cylindrical processing surface. As a grindstone for processing a flat surface, what is used is a cylindrical grindstone having a processing surface on its outer peripheral surface or a cup-shaped, ring-shaped or disk-shaped grindstone having a processing surface on its flat end face.

Conventionally, there has been a grindstone having a honeycomb structure (see, for example, Patent Document 1). In such a grindstone, there are provided a ceramic porous support having a large number of parallel through holes and an abrasive grain layer having super-abrasive grains fixed by a metal plating layer on the end face of the porous support, while openings corresponding to the through holes are formed in the abrasive grain layer.

In addition, Patent Document 2 discloses a grindstone which is formed by using a vitrified bond to fix super-abrasive grains made of diamond or CBN, and in which the shape of the abrasive material layer is formed into a honeycomb shape, and an abrasive material layer containing super abrasive grains is formed into lattice array and a region surrounded by the abrasive layer wall is a chip pocket for receiving ground chips.

CITATION LIST

Patent Document

Patent Document 1: Japanese Patent Application Laid-Open No. H4-129675

Patent Document 2: Japanese Patent Application Laid-Open No. 2004-255518

SUMMARY OF THE INVENTION

Technical Problems

However, the grindstone described in Patent Document 1 has a relatively short lifetime since its abrasive grain layer fixed by the metal plating layer is thin. Further, since abrasive grains are dispersed throughout the honeycomb structure, high-temperature ground chips scraped by the abrasive grains are fused onto the ridgelines of the honeycombs and this causes clogging and forms a hindrance to the next grinding/polishing.

In addition, although the grindstone described in Patent Document 2 solves the problem of short lifetime of grinding/polishing owing to its increased thickness of abrasive grain layer, high temperature ground chips scraped by the abrasive grains are still fused onto the ridgelines of the honeycombs, and this will still cause clogging, making it impossible to solve the problem of impeding the next grinding/polishing.

Namely, a conventional honeycomb structure has a linearly-shaped structure which is a continuum, and an inner space thereof is a closed space having a volume formed when the workpiece is in contact with the honeycomb structure. An adverse effect caused by this is that the air hammer phenomenon due to the air in the closed space occurs and expansion of the air occurs due to an increase in the temperature and the pressurized state is thus formed, inhibiting the workpiece from being in contact with the abrasive grain layer, or roughening the processed surface due to the undesired vibration.

A grinding rotatory direction and a ridgeline with a honeycomb structure are in contact with each other in a relation close to a right angle or a near parallel. Here, although the workpiece may be in a state of a metal or a glass-based inorganic material, the scraped ground chips will become soft, and in such a state the ground chips will be in contact with subsequent abrasive grains and will fuse and this will cause clogging.

The present invention has been accomplished in view of the above circumstances, and it is an object of the present invention to provide a grindstone capable of grinding, polishing, super-finish polishing with the same grindstone, and a grindstone capable of increasing an effective grinding pressure such that there will not be an air hammer phenomenon and there will not be any clogging even if the grindstone has been continuously used.

Solution to the Problems

In order to solve the above-described problems, a grindstone of the present invention is formed such that its grinding/polishing section for processing a workpiece has a honeycomb structure formed by arranging polygonal prisms with no clearance therebetween. Particularly, grindstone columns consisting of abrasive grains and a binder and having an axis L in depth direction of grinding/polishing surface are disposed on intersections or wall portions of the honeycomb structure.

In the present invention, by having the grindstone columns disposed at the intersection or the wall portions of the honeycomb structure, the ridges of the honeycomb become serrated portions as the grinding process progresses. Hence, even if the workpiece and the honeycomb structure are in contact with each other, since spaces formed therebetween will not be closed, it is possible to avoid an air hammer phenomenon which is otherwise caused due to pressurization.

In the present invention, so-called honeycomb structure refers to a configuration in which polygonal columns are arranged without forming any gaps.

Since each grindstone column includes abrasive grains for grinding and polishing a workpiece and also includes a binder, and since the grindstone columns have a large number of columns arranged in parallel and each has an axis L in the depth direction of grinding/polishing surface, the workpiece and grindstone columns contact each other at points and the number of contact points can be reduced, so that it becomes possible to increase an effective pressure for grinding, thereby improving the grinding performance. Further, a polishing process can be performed by discharging cooling fluids which can be liquid or gas, such as a cooling water from the grindstone surface and adjusting a distance between the grindstone and the workpiece. In this way, even if worn abrasive grains exposed on the grinding/polishing surface fall off, abrasive grains buried in the lower grinding/polishing layer will be exposed, so that grinding/polishing can be continued while maintaining the processing speed. In addition, when porous elastomer is placed into the hollow portion of each honeycomb structure, the elastomer will expand by flowing a cooling water, polishing liquid or the like at a high pressure, so that the elastomer will directly contact the workpiece, thus rendering it possible to perform a super-finish polishing with abrasive grains.

Also, even if there are ridge lines of honeycomb structure moving in parallel to the workpiece, there are void spaces of honeycomb structure behind the abrasive grains, and before the ground chips come into contact with the next abrasive grains, the ground chips will be separated and cooled in the spaces, thereby preventing the clogging.

In the above configuration of the present invention, it is preferable that the axis L of each grindstone column is arranged to be inclined in the rotating direction of the grindstone.

In this way, since grinding is performed with a rake angle that is inclined with respect to the grinding/polishing surface, it is possible to more efficiently perform a grinding process in a shorter time.

Further, in the above configuration of the present invention, it is preferable that the rotating direction of the grindstone is an inclining direction of the grindstone column or an opposite direction thereto.

In this way, during polishing, the material such as a workpiece can be rotated in a direction opposite to the rotating direction during grinding, and since the workpiece can be stroked with grindstone columns, it is possible to obtain a smoother finished surface.

In the above configuration of the present invention, it is preferable that the grinding/polishing section is formed integrally with the porous grindstone base, and a slurry containing a cooling fluid and a chemical abrasive is passed through the grinding/polishing section from the base of the grindstone, and supplied between the workpiece and the grindstone.

By doing so, the slurry containing the cooling fluid and the chemical abrasive is supplied between the workpiece and the grindstone column via the pores, thereby supplying a pressurized fluid to the fluid flow path, causing the grindstone to float from the workpiece, making it possible to perform the polishing process with a reduced processing speed. Further, as described later, when the porous elastomer is packed into the honeycomb structure polygonal prism, if the elastomer is actively expanded, it is possible to perform a super-finish polishing with floating abrasive grains without causing the fixed abrasive grains to be in contact with the workpiece.

Further, in the above configuration of the present invention, it is preferable that a space surrounded by the wall portions forming the honeycomb structure is hollow.

In this way, the space surrounded by the wall portions forming the honeycomb structure can be used as a pocket for trapping the ground chips of the workpiece.

Further, in the above configuration of the present invention, the space surrounded by the wall portions forming the honeycomb structure may be filled with a porous elastomer.

In this way, since the space surrounded by the wall portions forming the honeycomb structure is filled with the porous elastomer, it is possible to continuously perform the whole process from the grinding to the super-finish polishing.

In the above configuration of the present invention, it is preferable that the porous elastomer is drawn into the grinding/polishing section by reducing the pressure at the grindstone base or setting the pressure at an atmospheric pressure.

In this way, since the porous elastomer is drawn into the grinding/polishing section, the honeycomb structure having the grindstone columns can come into direct contact with the workpiece surface, so that it is possible to carry out the grinding process with a high efficiency, thereby enabling the inner space of the grinding/polishing section to be used as a pocket to trap the ground chips.

In the above configuration of the present invention, by pressurizing the grindstone base portion, it is possible that the cooling medium can be discharged through the pores of the porous elastomer by pressurizing the cooling medium and it is also possible for the porous elastomer to be extruded to the outside of the grinding/polishing section by increasing the outflow pressure of the cooling medium.

In this way, the porous elastomer extruded to the outside can break the contact between the workpiece and the honeycomb structure, and the elastomer itself can work as a buff during buffing process and efficiently perform the super-finish polishing process

Effects of the Invention

According to the present invention, it is possible to provide a grindstone which does not cause an air hammer phenomenon even when it is continuously used. In addition, when a porous elastomer is used at the same time, it is possible to provide a grindstone capable of continuously grinding, polishing and super-finish polishing with the same grindstone.

Further, according to the present invention, it is possible to increase the effects of grinding/polishing, carrying out a process beginning with a rough grinding to a finish polishing, using the same apparatus and the same grindstone within a shortened time.

BRIEF DESCRIPTION OF THE DRAWINGS

FIG. 1 is a plan view showing an embodiment of a grindstone of the present invention.

FIG. 2 is a partially enlarged view showing an embodiment of a grindstone of the present invention.

FIG. 3 is a cross-sectional view showing an embodiment of a grindstone of the present invention.

FIG. 4 is a schematic view showing the structure of a grindstone column used in the present invention.

FIG. 5 is a perspective view showing an embodiment of a grindstone of the present invention.

FIG. 6 is a view showing an embodiment of a grinding/polishing apparatus using the grindstone of the present invention.

FIG. 7 is a perspective view showing an embodiment of a grindstone of the present invention.

FIG. 8 is a view showing an embodiment of a grindstone of the present invention, in which (a) is a plan view and (b) is a cross sectional view taken along line A-A' in (a).

FIG. 9 is a view showing an embodiment of a grindstone of the present invention, in which (a) is a side view and (b) is a cross sectional view taken along line B-B' in (a).

FIG. 10 is an explanatory view showing an inclination angle of a grindstone column used in the present invention.

DESCRIPTION OF EMBODIMENTS

Hereinafter, embodiments of the present invention will be described in detail with reference to the accompanying drawings.

FIG. 1 is a plan view showing an embodiment of a grindstone formed according to the present invention, wherein FIG. 1(*a*) shows a disk-shaped grindstone and FIG. 1(*b*) shows a donut-shaped grindstone.

As shown in FIG. 1, the grindstone of the present embodiment is formed such that its grinding/polishing section (grinding/polishing layer) 1 for processing a workpiece W has a honeycomb structure. The cross-sectional shape of the honeycomb structure is a hexagon. As for the sectional shape of the honeycomb structure, it is possible to randomly arrange a geometric pattern composed of triangles, quadrangles, polygons, or combinations thereof.

A workpiece W to be processed by the grindstone may be ceramics, a silicon wafer, a semiconductor substrate, an LED substrate, a heat radiation substrate, SiC, alumina, sapphire, a metal, an alloy, or the like. Here, grinding/polishing refers to both grinding and polishing.

FIG. 2 is a partially enlarged view of FIG. 1 showing an embodiment of the grindstone according to the present invention.

The grindstone shown in FIG. 2(*a*) includes grindstone columns 2 composed of abrasive grains 5 and a sort of binder 6, each located at an intersection of each honeycomb structure. The grindstone columns 2 are composed of many columns arranged in parallel to one another, each having an axis L in the depth direction of the grinding/polishing surface. Besides, the grinding/polishing wall portion 1 is also a porous body.

Since the grindstone includes grindstone columns 2 consisting of many columns arranged in parallel to one another and each having an axis L in the depth direction of the grinding/polishing surface, the workpiece Wand the grindstone columns can contact each other at smaller area and less points, so that an effective pressure rises, thus improving the grinding performance. Furthermore, even if the worn abrasive grains exposed on the grinding/polishing surface fall off, the abrasive grains buried in the lower layer will be exposed, whereby maintaining a desired processing speed, and thus rendering it possible to continuously perform the grinding/polishing.

Further, even if there are ridge lines of a honeycomb structure moving in parallel to the workpiece W, spaces are formed behind the abrasive grains, and the ground chips will be separated from the grindstone in the spaces and cooled before contacting the next abrasive grains, so that it is possible to prevent clogging.

The grindstone shown in FIG. 2(*b*) includes grindstone columns 2, each located on a wall portion of a honeycomb structure, consisting of abrasive grains 5 and a sort of binder and having an axis L in the depth direction of the grinding/polishing surface. In fact, there are a plurality of such columns arranged in parallel to one another.

Spaces surrounded by the wall portions forming the honeycomb structures shown in FIGS. 2(*a*) and (*b*) are hollow. Such kind of spaces serves as pockets for trapping the ground chips of the workpiece W.

FIG. 3 is a cross-sectional view showing an embodiment of the grindstone of the present invention.

As shown in FIG. 3, the grinding/polishing section 1 is integrally formed with the porous grindstone base section 3, and spaces surrounded by the wall portions forming the honeycomb structures are filled with the porous elastomer 4.

In FIG. 3(*a*), the porous elastomer 4 is further drawn into the grinding/polishing section 1 by reducing the pressure at the grindstone base 3 to a reduced pressure or an atmospheric pressure.

As shown in FIG. 3(*b*), the porous elastomer 4 is extruded to the outside of the grinding/polishing section 1 by increasing the pressure at the grindstone base 3.

FIG. 4 is a schematic view showing the structure of a grindstone column used in the present invention. FIG. 4(*a*) shows a state before sintering and FIG. 4(*b*) shows a state after sintering. After the sintering, the binder 6 melts to wrap the abrasive grains 5 to combine the abrasive grains 5 together.

The grindstone of the present embodiment is composed of abrasive grains 5 for grinding/polishing a workpiece W and a sort of binder 6. The grindstone includes grindstone columns 2 consisting of many columns arranged in parallel to one another, each having an axis L in the depth direction of the grinding/polishing surface. In this way, even if the abrasive grains exposed on the grinding/polishing surface fall off, the abrasive grains buried in the lower layer will be exposed, whereby maintaining a desired processing speed, and thus rendering it possible to continuously perform the grinding/polishing. The binder 6 is mixed as shown in FIG. 4(*a*), but after sintering, abrasive grains 5 are connected with each other to form columns such that the binder 6 melts to wrap the abrasive grains 5. However, the shape of the grindstone 2 is not limited to a cylindrical shape shown in FIG. 4, but it may be a prism column or a column made of a thin plate.

On the other hand, diamond may be used to form the abrasive grains 5, and the average grain size thereof is 0.1 to 300 μm. However, instead of diamond, it is also possible to use a cubic boron nitride (CBN) abrasive grains which is CBN, and it is further possible to use a mixture of diamond and CBN. In addition, it is possible to use silicon carbide SiC which is GC, Mullite ($3Al_2O_3$-$2SiO_2$), or fused alumina $Al_2O_3$, i.e., WA alone or a mixture thereof. Moreover, vitrified bonds may be used as the binding material 6 for forming the grindstone, but as the binding materials 6, it is also possible to use resinoid bond, metal bond, electrodeposited bond in addition to vitrified bonds. On the other hand, when the cross section of the abrasive grains 5 is not circular, the average grain size of the abrasive grains 5 should be an average value of the diameters of equivalent circles having the same cross-sectional area.

If the workpiece W is a flat plate, the grindstone can have a disk shape having a thickness of 5-10 mm, consisting of a flat piece shown in FIG. 1. On the other hand, if the workpiece's surface to be processed in grinding/polishing is a curved surface, it is still possible to perform the grinding/polishing on the workpiece having such a complex shape, by arranging, on the outer periphery of the disc-shaped grindstone, the grindstone columns 2 consisting of many columns arranged in parallel to one another and each having an axis L in the radio direction of the disk shape.

When a grindstone includes the grinding/polishing sections 1, the grindstone columns 2, the grindstone base section 3 and the porous elastomer 4, it is preferable that the porous body has a porosity of 20-60 volume %. The reason for the lower limit (20%) of the porosity is that a porous body having a porosity equal to or less than 20% will produce pores 7 which will mostly become closed pores, rather than open pores, rendering it impossible for air or coolant to enter or exit the pores due to a vacuum condition. On the other hand, the reason for the upper limit (60%) of the porosity is that a porous body having a porosity equal to or more than 60% will produce a mixed powder of the abrasive grains 5 and the binder 6, having a bulk density of about 60% at the most. The sintering process is carried out under above-described condition.

When a grindstone includes the grinding/polishing sections 1, the grindstone columns 2, the grindstone base section 3 and the porous elastomer 4, it is possible to obtain the following effects owning to the fact that the porous body has a porosity of 20-60 volume %.

When a grindstone includes the grinding/polishing sections 1, the grindstone columns 2, the grindstone base section 3 and the porous elastomer 4, the porous body can make it possible to have the grindstone surface become evacuated and the distance between the abrasive grains and the workpiece will become closer to each other.

Making the grindstone porous, it is possible to control the distance between the grindstone and the grinding surface of the workpiece W by directly discharging a coolant such as water, and to eliminate unnecessary adhesion of the workpiece to the grindstone.

In this way, directly discharging a coolant such as water from the grindstone, makes it possible to perform the cooling and polishing during the grindstone processing.

Further, when the pores of the grinding/polishing section 1, the pores inside the grindstone columns 2, and the porous elastomer 4 are all disposed, a coolant, a slurry containing a chemical abrasive, or a mixture thereof can be supplied between he workpiece W and the grindstone through these pores.

Further, by using a vacuum device such as a vacuum pump, it is possible to reduce a pressure between the workpiece W and the grindstone through the pores in the grinding/polishing section 1, the grindstone columns 2, the grindstone base section 3, and the porous elastomer 4.

Using the above described grindstone, it is possible to provide a grinding/polishing apparatus capable of exhibiting the following actions and effects.

Making it possible to have the grindstone surface to be in a vacuum state.

Making it possible to have pore structure to be able to discharge a coolant such as water from the grindstone.

Making it possible to omit the dressing of grindstone. Making it possible to simultaneously perform a lapping grinding and a finish polishing.

FIG. 5 is a perspective view showing a grindstone according to one embodiment of the present invention, and FIG. 6 is a sectional view showing a state where the grindstone shown in FIG. 5 is attached to a grindstone holder. In the following embodiments, the workpiece W is a silicon wafer.

The grindstone 10 shown in FIG. 5 has a disk shape, with an image of honeycomb structure being omitted from the figure. One end surface of the grindstone 10 serves as a processing surface 11, and the other end surface thereof serves as a base end surface 12. As shown in FIG. 6, the grindstone 10 is disposed such that its base end face 12 abuts against the grindstone holder 20, rendering it possible to have the grindstone 10 to be rotationally driven by the grindstone holder 20. The grindstone 10 is adapted to be attached to the grindstone holder 20 by bolts 14 screwed into the grindstone holder 20 through the attachment holes 13 formed in the outer periphery of the grindstone 10.

The grindstone 10 is formed by abrasive grains and a sort of binder which connects abrasive grains to one another, and is formed as a porous body having microscopic pores 7 therein.

As shown in FIG. 6, the grindstone 10 is adapted to be attached to a grindstone rotating shaft 22 of the polishing apparatus via a grindstone holder 20. Thus, the grindstone 10 can be rotationally driven through the grindstone holder 20 by virtue of a motor (not shown) which drives the grindstone rotating shaft 22. Fluid guide flow path 23 formed in the grindstone rotating shaft 22 is connected to the vacuum pump 25 via the rotary joint 24. A fluid guide flow path 26*a* connecting the vacuum pump 25 and the rotary joint 24 is provided with a flow path on-off value 27*a* and a pressure regulating valve 28*a*. Therefore, when the vacuum pump 25 is operated under a state where the flow path on-off valve 27*a* is opened, if the grinding/polishing section 1, the inside of the grindstone column 2, and the porous elastomer 4 are all disposed, the pores thereof will be communicated with the vacuum pump 25 via the fluid guide flow path 23, so as to be in a vacuum state which is a negative pressure lower than the atmospheric pressure, thereby enabling abrasive grains of the grindstone 10 to dig into the workpiece efficiently.

A pressurizing pump 29 is connected to the rotary joint 24, and a flow path on-off valve 27*b* and a pressure regulating valve 28*b* are attached to a fluid guide flow path 26*b* connecting the pressurizing pump 29 and the rotary joint 24. The pressurizing pump 29 pressurizes and discharges a liquid such as the polishing liquid stored in the container 30 and the pressurizing pump 29 is operated under a condition where the flow path on-off valve 27*b* is opened. As a result, the liquid is guided via the fluid guide flow path 23, and flows into these pores and flows out from the processing surface 11, passing through the grinding/polishing section 1, the inside of the grindstone 2, and the porous elastomer 4.

Above the grindstone rotating shaft 22, there is provided a workpiece rotating shaft 32 mounted with a vacuum chuck 31 for supporting and rotating a workpiece W such as a silicon wafer. The workpiece rotating shaft 32 is movable in the horizontal direction along the processing surface 11 of the grindstone 10 and is also movable in the vertical direction, thus making it possible to have the workpiece W supported by the vacuum chuck 31 to move toward or away from the grindstone 10. Further, under a condition in which the workpiece W is in contact with the grindstone 10, it is possible to apply a pressing force to the workpiece W, making use of the self-weights of the workpiece rotating shaft 32 and the vacuum chuck 31. In addition to the pressing force based on such self-weight, it is also possible to use a pneumatic cylinder or the like to add a pushing force to the workpiece rotating shaft 32, thus increasing the pressing force.

The vacuum chuck 31 has a chuck plate 34 including a plurality of suction holes 33 formed therein, and a vacuum flow path 35 communicating with the respective suction holes 33 is formed in the workpiece rotating shaft 32. The vacuum flow path 35 is connected to a vacuum pump 37 via a rotary joint 36, and a flow path on-off valve 39 is attached to a vacuum supply path 38 connecting the vacuum pump 37 and the rotary joint 36. Therefore, when the vacuum pump 37 is operated to set the pressure of the vacuum flow path 35 to a pressure lower than the atmospheric pressure, external air will flow into the air intake holes 33, and the workpiece W can thus be vacuum sucked and held by the vacuum chuck 31. Further, if the upper structure is made similar to the above-described grindstone and attached thereto, it is possible to perform a double-sided processing on the workpiece W. At this time, the workpiece may be kept by a sheet-like material having holes formed thereon.

A polishing process using the grindstone 10 includes polishing the workpiece W, by pressurizing a refrigerant using the pressurizing pump 29 to allow the refrigerant to flow from the processing surface 11 via the fluid flow path 17. The polishing process also includes polishing the surface of the wafer before the circuit pattern formation thereon or the wafer on which the circuit pattern has already been formed, by adjusting a distance between the processing surface 11 and the workpiece W (i.e., a distance between the abrasive grains and the surface to be processed). In addition, it is possible to apply the grindstone 10 to the polishing of the workpiece W, which pressurizes the polishing liquid containing loose abrasive grains by the pressurizing pump 29 and allows the polishing liquid to flow from the processing surface 11 via the fluid flow path 17. Besides, the grindstone 10 can also be applied to the polishing of the wafer before the circuit pattern formation thereon or the wafer on which the circuit pattern has already been formed, by causing a slurry containing a chemical polishing agent to flow from the processing surface 11, which may also be called CMP processing. In such a polishing process, since a polishing liquid or the like is supplied between the grindstone 10 and the workpiece W from the processing surface 11, it is possible to exactly supply the polishing liquid to the entire surface of the workpiece W which is to be processed. Moreover, as compared with a polishing pad made of urethane or the like as in an ordinary CMP process, the hardness of the processing surface 11 of the grindstone 10 is higher than that of the polishing pad made of urethane or the like, so that the surface of the wafer can be polished with a high flatness without causing swell on the surface of the wafer. Further, by adjusting the pressure between the processing surface 11 and the workpiece W, it is possible to easily set a necessary time and an amount of polishing.

In order to manufacture the grindstone 10 in which the fluid flow paths 17, 18 have been formed, a mixture of the abrasive grains, the binder and the auxiliary agent are injected into a mold. On the other hand, a core made of a vanishing material that disappears when heat is applied, such as a vanishing resin, is in advance formed into the shape of the fluid flow paths 17, 18, and when the mixture is injected into the mold, the core is injected into the mixture. By heating the grindstone material formed into a shape corresponding to the grindstone 10 using the sintering furnace in this way, the core disappears and the abrasive grains are connected together by the binder, thereby integrally forming the grindstone 10 consisting of a porous body which contains the pores and in which the fluid passages 17, 18 have been formed, all under a condition where the pores of the grinding/polishing section 1, the pores in the grindstone 2, and the porous elastomer 4 are provided. The porosity of the grindstone 10 decreases as the amount of the auxiliary agent is increased, but in addition to the amount of the auxiliary agent, the porosity can be adjusted also by adjusting the sintering temperature or the like.

Therefore, when the grindstone 10 is formed by the grinding/polishing section 1 and the grindstone base 16 as described above, the amounts of auxiliary agent may be made different between the grinding/polishing section 1 and the grindstone base section 16, so that a portion in which the fluid flow path 17 is formed among the grinding/polishing section 1 and the grindstone base section 16 may be used as a porous body having an open pore structure, thereby rendering it possible to use a portion extending from this position to the base end face 12 as a porous body with a closed pore structure.

The abrasive grains 5 constituting the grindstone columns 2, are diamond abrasive grains having an average grain size 0.1-300 μm. On the other hand, rather than using diamond, it is also possible to use cubic boron nitride (CBN) abrasive grains, a mixture of diamond and CBN, silicon carbide SiC (GC), Mullite ($3Al_2O_3$-$2SiO_2$), or fused alumina $Al_2O_3$ (WA) alone, or a mixture thereof. As a binder for use in forming the grindstone 10, although it is possible to use a vitrified bond, it is also possible to use various other bonding materials such as resinoid bond, metal bond, electrodeposited bond and the like.

In the following, the description will be given to explain how to prevent a clogging, describing a feature of the present invention. A reason why the grindstone can no longer be used is not only when a necessity of sharpening occurs, but also when clogging occurs. When grinding and polishing hard objects like sapphire, the problem of clogging does not occur in many cases. However, clogging will occur when processing ceramics which are softer than sapphire or a material such as metals or alloys. This is a phenomenon in which the ground chips remain at a high temperature and clogging occurs between the abrasive grains of grindstone, causing the grindstone surface to become flattened, and the abrasive grains no longer protruding, making it impossible to be used in grinding. In this regard, in order to lower the temperature of the ground chips, which are temporarily kept in the tip pockets, or a fluid (a coolant such as water or air) like water is pulled out from the pores and the temperatures of chips and abrasive grains are lowered, while the chips are prevented from contacting the abrasive grains at a high temperature, thereby inhibiting the clogging and removing the chips by putting in and discharging the fluid.

In addition, processing speed can be increased by double-side processing. However, when double-sided processing is performed, particularly in the case of processing thin workpieces, the thin workpieces will adhere to the surface of the grindstone due to the surface tension of the coolant such as water, so that a desired removing off becomes difficult. When processing a plurality of workpieces W, some workpieces W will adhere to the surface on one side of the grindstone, while the remaining workpieces W will adhere to the surface on the other side of the grindstone, making it impossible to carry out an automated fabrication process and a mass-production.

Moreover, although a workpiece W such as a silicon substrate or the like has become thinner and thinner, the processing limitation thereof is one side processing. As a result, a difference between the processed surface and the unprocessed surface occurs, so that the thin workpiece can no longer be processed because it becomes warped. On the other hand, by processing a workpiece on both sides thereof, since both surfaces change in the same way, warping can be eliminated.

In addition, although a workpiece W such as a silicon substrate or the like has become thinner and thinner, there is a possibility that a difference between the processed surface and the unprocessed surface occurs when it is subjected to a single-side processing, and it may be warped and becomes unusable. At this time, by processing it on the both side surfaces together thereof, since both surfaces change in the same way, warping can be eliminated.

However, when a double-sided processing with an upper and a lower grinding stones is performed for multiple workpieces W using a conventional grinding/polishing apparatus, since a coolant such as water is introduced, a surface tension of the coolant will cause some of the workpieces attached to the upper grindstone, and the other workpiece attached to the lower grinding stone, when the upper grindstone is raised after finishing the processing. In order to peel the workpieces off from the grindstones, it is necessary to add more steps. If the peeling off turns out to be a failure, the workpieces will be damaged though they have at last been processed into a thin piece. Accordingly, in general, a double-sided processing machine can only be limited to a rough processing or to be limited to a condition where a relatively thick workpieces W are processed.

Therefore, when two grindstones which represent a preferred embodiment of the present invention, are placed with one upper and the other lower in the vertical direction and a workpiece W is sandwiched therebetween, a fluid (which may be a liquid such as water or a gas such as air) is ejected out from one of the grindstones. In this way, the workpieces W can be prevented from adhering to the grindstone and the workpieces W can be easily taken out. As a result, a double-sided automated processing becomes possible in a polishing process even when processing thin workpieces.

FIGS. 8, and 9 show an embodiment in which the axis L of each grindstone column used in the present invention is inclined in the rotating direction of the grindstone. FIG. 8 shows a case in which a flat grindstone is used, and FIG. 9 shows a case in which (a) a straight grindstone, and (b) a cup-like grindstone is used.

As shown in FIGS. 8, and 9, the grindstone of the present embodiment is formed such that its grinding/polishing section 1 for processing the workpiece W has a honeycomb structure. The cross-sectional shape of the honeycomb structure is a hexagon. As for the sectional shape of the honeycomb structure, it is possible to randomly arrange geometric patterns composed of triangles, quadrangles, polygons, or the combinations thereof.

As shown in FIG. 8(*b*) and FIG. 9(*b*), the axis L of each grindstone 2 is arranged to be inclined in the rotating direction of the grindstone. As shown in FIG. 10, an inclining angle θ of the grindstone 2 is an angle between the depth direction orthogonal to the grinding/polishing surface and the axis L of the grindstone 2. In order to efficiently grind the workpiece W, the angle θ is preferred to be between 0° and 60°.

According to the above, since the grindstone 2 grinds the workpiece W with a rake angle that is inclined with respect to the grinding/polishing surface, it is possible to more efficiently perform grinding in a short time.

Further, the rotating direction of the grindstone shown in FIGS. 8 and 9 is preferably an inclined direction of the grindstone or the opposite direction thereof.

In this way, during polishing, it is possible to cause the grindstone to be rotated in a direction opposite to the grinding direction, and it is thus possible to use the grindstone to stroke the workpiece, thereby making it possible to realize a smoother finished surface.

EXAMPLES

Using the flat grindstone of the present invention shown in FIGS. 1-6, the straight grindstone in FIG. 7, and a cup grindstone shown in FIG. 9(*b*), experiments were carried out in the following condition. Namely, the grindstone thickness corresponding to the diameter D of the grindstone column which is within the scope of the present invention is set to be 1-2 mm which is within the range of 1-100 times the average particle size. A spacing S between adjacent grindstone columns is set to be 10-20 mm which is within the range of 10-1000 times a thickness corresponding to the diameter D of the grindstone column. The porosity of the grindstone column and grindstone base portion 3 is set to be 30%-60%. The total ratio of the sectional area of the grindstone to the area of the grinding/polishing surface of the grindstone was 0.4-7.0%, which was lower than a conventional grindstone. Diamond having an average particle size of 20 μm was used as abrasive grains.

Advantages can be confirmed in an embodiment where diamond is used as the abrasive grain and the workpiece W is sapphire. Here, if the grindstone of the present invention is used, even if the pressing force on the workpiece W is reduced from 30 kPa to 20 kPa and then restored to 30 kPa again, the grinding/polishing processing speed can be maintained so that the effect of the present invention can be confirmed. On the other hand, a conventional grindstone has a low processing speed during the first 20 minutes and thus requires a dressing, making it difficult to continue the processing without a dressing. Different from the conventional grindstone, the grindstone of the present invention shows that when an applied pressure is returned without a dressing, a processing speed can return, thereby realizing a processing without a dressing.

According to the present invention, when using abrasive grains which are utilized in a rough processing and thus improving the sharpness of abrasive grains, it is possible to obtain the following advantages.

- Enabling a processing at a speed higher than an ordinary rough processing.
- Suppressing defects during a rough processing.
- Rendering it possible to smoothen a finished surface of rough processing, thus omitting a lapping step after rough processing.
- Rendering it possible to control a grinding speed during a rough processing, thereby ensuring an improved accuracy in dimension.
- Ensuring an improved efficiency for processing by setting a workpiece in the same machine from a rough processing to a supper-finish polishing.
- Rendering it possible to perform a double-sided processing from a rough processing to a supper finish polishing by using the same machine, thereby ensuring a high efficiency in processing.

EXPLANATION OF REFERENCE NUMERALS

1 Grinding/polishing section
2 Grindstone column
3 Grindstone base
4 Porous elastomer
5 Abrasive grains
6 binder
7 pores
L Axis of grindstone
D Diameter of grindstone column
S Spacing between grindstone columns or hexagon opening

The invention claimed is:

1. A grindstone in which a grinding/polishing section for processing a workpiece has a honeycomb structure formed by arranging polygonal prisms with no clearance therebetween, and a plurality of separated grindstone columns, wherein each grindstone column of the plurality of separated grindstone columns:

consists of abrasive grains and a binder, has an axis L in depth direction of grinding/polishing surface, and is disposed on intersections or wall portions of the honeycomb structure.

2. The grindstone according to claim 1, wherein the axis L of each grindstone column is disposed to be inclined in the rotating direction of the grindstone.

3. The grindstone according to claim 2, wherein the rotating direction of the grindstone is an inclining direction of grindstone column or an opposite direction thereof.

4. The grindstone according to claim 1, wherein the grinding/polishing section is formed integrally with the porous grindstone base, and a slurry containing a cooling liquid and a chemical abrasive is passed through the grinding/polishing section from the base of the grindstone, and supplied between the workpiece and the grindstone.

5. The grindstone according to claim 1, wherein a space surrounded by wall portions constituting the honeycomb structure is hollow.

6. The grindstone according to claim 1, wherein a space surrounded by wall portions constituting the honeycomb structure is filled with a porous elastomer.

7. The grindstone according to claim 6, wherein the porous elastomer is drawn into the grinding/polishing section by reducing a pressure at the base of the grindstone, or making the pressure to be an atmospheric pressure.

8. The grindstone according to claim 6, wherein the porous elastomer is extruded to the outside of the grinding/polishing section by pressurizing the grindstone base.

* * * * *